US010502497B1

(12) United States Patent
Weyant et al.

(10) Patent No.: US 10,502,497 B1
(45) Date of Patent: Dec. 10, 2019

(54) CONSTANT CONDUCTANCE HEAT PIPE ASSEMBLY FOR HIGH HEAT FLUX

(71) Applicant: ADVANCED COOLING TECHNOLOGIES, INC., Lancaster, PA (US)

(72) Inventors: Jens E. Weyant, Hershey, PA (US); Michael Dechristopher, Leola, PA (US); William G. Anderson, Bound Brook, NJ (US)

(73) Assignee: ADVANCED COOLING TECHNOLOGIES, INC., Lancaster, PA (US)

( * ) Notice: Subject to any disclaimer, the term of this patent is extended or adjusted under 35 U.S.C. 154(b) by 57 days.

(21) Appl. No.: 15/878,786

(22) Filed: Jan. 24, 2018

Related U.S. Application Data

(62) Division of application No. 15/093,476, filed on Apr. 7, 2016, now Pat. No. 9,952,000.

(60) Provisional application No. 62/147,861, filed on Apr. 15, 2015.

(51) Int. Cl.

| | |
|---|---|
| ***F28D 15/00*** | (2006.01) |
| ***F28D 15/02*** | (2006.01) |
| ***F28D 15/04*** | (2006.01) |
| *F28D 21/00* | (2006.01) |

(52) U.S. Cl.
CPC ..... *F28D 15/0266* (2013.01); *F28D 15/0275* (2013.01); *F28D 15/046* (2013.01); *F28D 2021/0021* (2013.01); *F28D 2021/0028* (2013.01)

(58) Field of Classification Search
CPC ..... F28D 15/0266; F28D 15/0275; F28D 15/046; F28D 2021/0021; F28D 2021/0028; F25B 23/006
USPC ..... 165/104.14
See application file for complete search history.

(56) References Cited

U.S. PATENT DOCUMENTS

| | | | |
|---|---|---|---|
| 3,862,481 | A | 1/1975 | Van Geenen |
| 4,351,388 | A | 9/1982 | Calhoun et al. |
| 4,470,451 | A | 9/1984 | Alario et al. |
| 4,765,396 | A | 8/1988 | Seidenburg |
| 4,883,116 | A | 11/1989 | Seidenburg et al. |
| 4,890,668 | A | 1/1990 | Cima |
| 6,227,288 | B1 | 5/2001 | Gluck et al. |
| 6,997,245 | B2 | 2/2006 | Lindemuth et al. |
| 7,013,958 | B2 | 3/2006 | Garner et al. |
| 7,028,759 | B2 | 4/2006 | Rosenfeld et al. |
| 7,124,809 | B2 | 10/2006 | Rosenfeld et al. |
| 7,137,443 | B2 | 11/2006 | Rosenfeld et al. |

(Continued)

FOREIGN PATENT DOCUMENTS

| | | | |
|---|---|---|---|
| JP | 2009041825 | A | 2/2009 |
| KR | 20100132212 | A | 12/2010 |

*Primary Examiner* — Davis D Hwu
(74) *Attorney, Agent, or Firm* — McNees Wallace & Nurick LLC

(57) ABSTRACT

A heat pipe assembly that includes at least one axial groove heat pipe and at least one porous media heat pipe. The porous media heat pipe may be embedded into a flange of the axial groove heat pipe, or embedded into a wall of the axial groove heat pipe, or embedded into another bore of the axial groove heat pipe. The evaporator of the at least one porous media heat pipe may be located remotely and can accept a high heat flux, while a condenser of the at least one porous media heat pipe is attached to the axial groove heat pipe.

5 Claims, 3 Drawing Sheets

(56) References Cited

U.S. PATENT DOCUMENTS

| | | | | |
|---|---|---|---|---|
| 7,347,455 | B1 | 3/2008 | Taquino | |
| 7,861,768 | B1 | 1/2011 | Ghantiwala | |
| 8,136,580 | B2 * | 3/2012 | Kroliczek | F25B 23/006 165/104.21 |
| 8,782,889 | B2 | 7/2014 | Chen | |
| 2005/0022984 | A1 | 2/2005 | Rosenfeld et al. | |
| 2006/0124281 | A1 | 6/2006 | Rosenfeld et al. | |
| 2009/0056917 | A1 | 3/2009 | Majumdar et al. | |
| 2011/0146955 | A1 | 6/2011 | Chen | |
| 2012/0048517 | A1 | 3/2012 | Huang et al. | |
| 2012/0097372 | A1 | 4/2012 | Furumoto et al. | |
| 2014/0083653 | A1 | 3/2014 | Kempers et al. | |
| 2014/0138061 | A1 | 5/2014 | Chen | |

* cited by examiner

CONSTANT CONDUCTANCE HEAT PIPE ASSEMBLY FOR HIGH HEAT FLUX

CROSS-REFERENCE TO RELATED APPLICATION

The application claims benefit from and is a Divisional Application of U.S. patent application Ser. No. 15/093,476 filed Apr. 7, 2016 entitled CONSTANT CONDUCTIVE HEAT PIPE ASSEMBLY FOR HIGH HEAT FLUX, which claims benefit from U.S. Provisional Patent Application No. 62/147,861, both of which are hereby incorporated by reference in their entirety.

FIELD OF THE INVENTION

The present invention is directed to a heat pipe for applications which experience high heat flux and which transport heat long distances. In particular, the invention is directed to a heat pipe assembly which combines heat pipes with a porous wick structure with heat pipes with an axial groove wick structure.

BACKGROUND OF THE INVENTION

Typical grooved wicks, used in spacecraft constant conductance heat pipes (CCHPs), diodes and Variable Conductance Heat Pipes (VCHPs), have a very high permeability, allowing very long heat pipes for operation in zero-g, typically several meters long. However, axial grooved constant conductance heat pipes have a relatively low heat flux limitation, on the order of 5 W/cm$^2$ before the heat pipe conductance drops off.

These grooved aluminum/ammonia heat pipes are designed to work with a 0.10 inch adverse elevation (evaporator elevated above the condenser). This allows them to be tested on earth prior to insertion in a spacecraft. However, they are very sensitive to adverse elevation. For example, increasing the heat pipe elevation by 0.10 inch will significantly decrease the power.

For applications with higher heat fluxes or with adverse elevation, loop heat pipes (LHPs) are currently used in place of constant conductance heat pipes. The disadvantage of LHPs is that they are significantly more expensive to fabricate and often are more difficult to start-up, sometimes requiring start-up heaters.

Heat spreaders are used to reduce the heat flux generated by the component to a level that is manageable by the heat pipe. Heat spreaders typically consist of aluminum plates but may also be made of carbon composites, pyrolytic graphite, copper, or any other thermally conductive material and/or other heat pipe assemblies. The use of heat spreaders can add significant weight, volume and cost the system. The thermal resistance of the system is also increased since at least two more thermal interfaces plus the conduction path of the spreader itself is introduced.

One type of heat spreader uses copper water heat pipes embedded into aluminum. Copper water heat pipes use a porous wick structure and are capable of handling heat fluxes up to 50 W/cm$^2$. Heat pipe embedded aluminum plates are used as heat spreaders and in some cases also as a structural member in electronics packaging. Embedding heat pipes increases the effective thermal conductivity by several factors without negatively affecting the plate's mass, strength or corrosion resistance. When designed properly, they can also operate against adverse elevations. In general, the performance of a heat pipe embedded aluminum plate is better than that of the high end composite materials but costs much less to manufacture. The typical thermal conductivity is roughly 600 to 1200 W/cm$^2$. The layout of the embedded heat pipes may be optimized based on the heat source profiles and locations. A higher number of heat pipes may be embedded in areas on the plate where large heat sources are attached. Even with the embedded heat pipes, the heat pipe embedded plate may weigh less than an equivalently sized conventional aluminum plate.

However, as the trend for electronics is driving toward higher performance from a smaller package, the heat flux is increased, which thereby increases the importance of thermal management. This is especially true for the satellite and aerospace industry where size and performance are critical design considerations. The use of heat spreaders is not sufficient to reduce the heat flux from the source to a level that can be accepted by the constant conductance heat pipe while allowing for reduced weight, volume, thermal resistance and cost to the system.

It would, therefore, be beneficial to provide a heat pipe assembly which can reduce the heat flux from the source to a level that can be accepted by the constant conductance heat pipes while also reducing the weight, volume, thermal resistance and cost to the system.

SUMMARY OF THE INVENTION

It is an object to combine heat pipes with a porous wick structure with one or more heat pipes that use an axial groove wick structure, wherein the resulting assembly can accept high heat fluxes and transport heat long distances.

It is an object to provide a heat pipe assembly in which the porous heat pipe acts as a flux transformer, accepting a high heat flux over one or more small areas, and supplying the heat to the grooved heat pipe. The porous wick pipe can also operate against higher adverse elevations than the axial groove pipe.

It is an object to provide a heat pipe assembly in which the grooved wick allows the heat pipe to operate in space, carrying power over long distances to the ultimate heat sink.

It is an object to provide a heat pipe assembly which eliminates the need for heat spreaders between the heat source and the heat pipe.

An embodiment is directed to a heat pipe assembly that includes at least one axial groove heat pipe and at least one porous media heat pipe. The porous media heat pipe may be embedded into a flange of the axial groove heat pipe, or embedded into a wall of the axial groove heat pipe, or embedded into another bore of the axial groove heat pipe.

An embodiment is directed to a heat pipe assembly in which the porous media heat pipe extends from the axial groove heat pipe to bridge the gap between the heat pipe assembly and a heat source.

Alternate embodiments are directed to a heat pipe assembly in which the porous media heat pipe is replaced with another high conductivity material or in which the porous media heat pipe is fabricated in the form of a vapor chamber.

An embodiment is directed to the heat pipe assembly which has a condenser flange which is removed from or remote from the axial grooved heat pipe. The condenser flange has porous media heat pipes embedded therein to improve the effective thermal conductivity, porous media heat pipes extend between the axial groove heat pipe and the condenser flanges between the axial groove heat pipes to allow and facilitate heat to be transferred from the axial groove heat pipe to the condenser flange.

An embodiment is directed to the heat pipe assembly which has a second axial groove heat pipe provided, porous media heat pipes extend between the axial groove heat pipes, heat supplied by electronic devices can be spread over both axial groove heat pipes.

An embodiment is directed to a heat pipe assembly that includes at least one axial groove heat pipe and at least one additional heat pipe with a porous wick in the evaporator. The evaporator being located remotely and can accept a high heat flux, a condenser of the at least one additional heat pipe being attached to the axial groove heat pipe.

An embodiment is directed to a heat pipe assembly with two bores, a first bore contains an axial groove wick and a second bore contains a porous wick in at least an evaporator section. During ground testing, the evaporator section is elevated above a condenser section and only the second bore which contains the porous wick carries power. In space, both the first and the second bores carry power.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
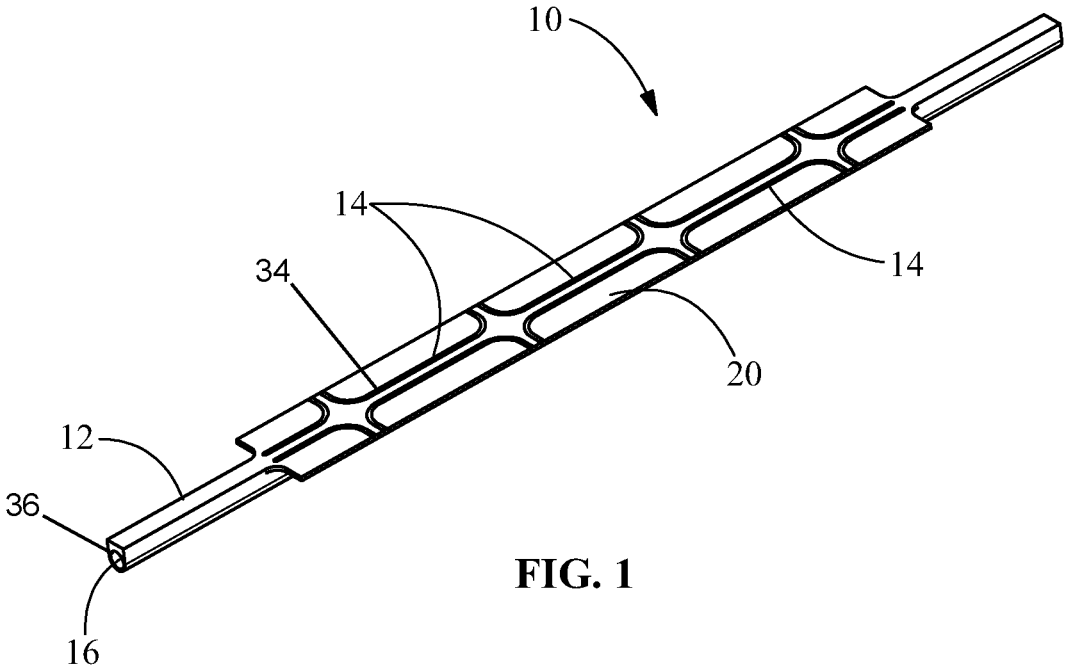
FIG. 1 is a partial perspective view of an illustrative embodiment of an axial groove heat pipe with an integral flange having multiple porous wick heat pipes embedded therein.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

In general, the embodiments are directed to a heat pipe assembly 10 which combines one or more heat pipes 14 with a porous wick structure or porous wick 34 with one or more heat pipes 12 that use an axial groove wick structure or grooved wick or axial groove wick 36, wherein the resulting assembly 10 can accept high heat fluxes and transport heat long distances. Each axial groove heat pipe 12 may have one or more bores 16. In various embodiments, heat spreaders 18 (FIG. 2) may also be used.

Figure 2:
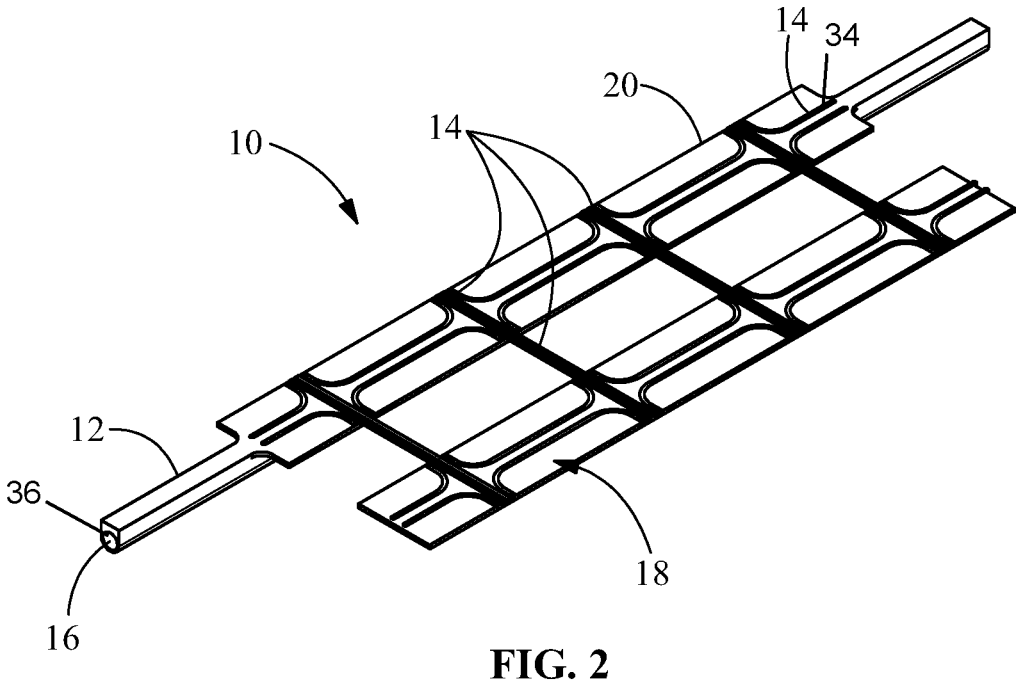
FIG. 2 is a partial perspective view of an illustrative embodiment of an axial groove heat pipe with integral flange that has multiple porous wick heat pipes embedded that also connect to a remote heat spreader.
Figure 3:
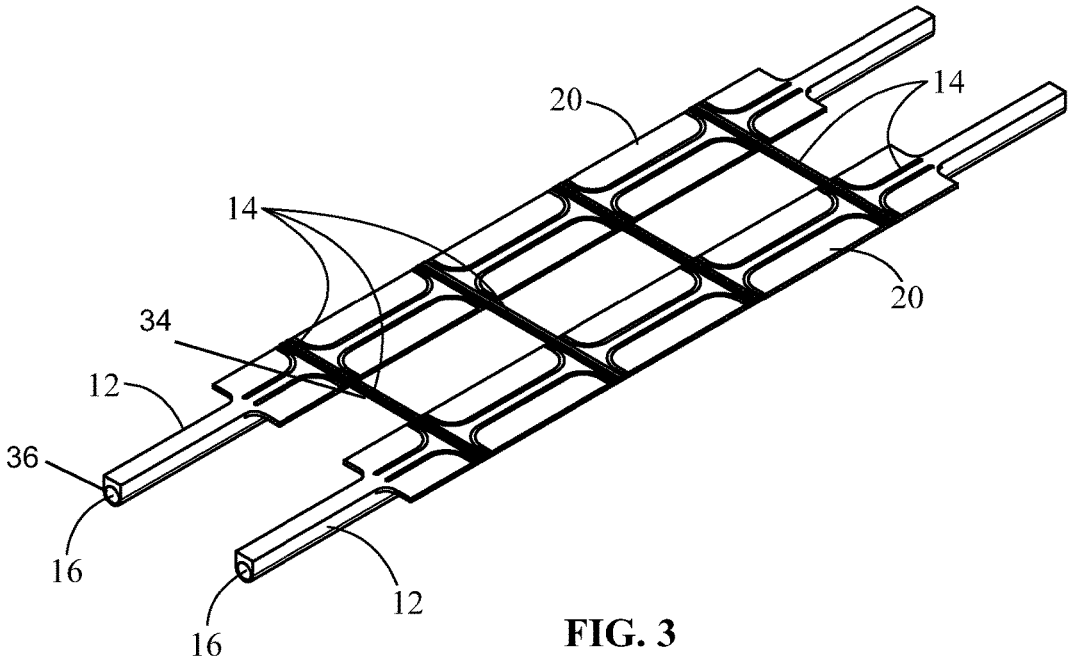
FIG. 3 is a partial perspective view of an illustrative embodiment of two axial groove heat pipes with integral flanges with multiple porous wick heat pipes embedded in them with porous media heat pipes connecting the axial groove heat pipes to allow the heat to be shared between the two axial groove heat pipes.

Referring to the illustrative embodiment shown in FIGS. 1 through 3, the porous media heat pipes 14 are embedded into the flanges 20 or walls of the axial grooved heat pipes 12. The porous media heat pipes 14 may be, but are not limited to copper-water heat pipes. The axial grooved heat pipes 12 may be, but are not limited to, aluminum-ammonia constant conductance heat pipes. The porous media heat pipes 14 can accept a heat flux up to 50 $W/cm^2$ or more. The heat is then spread along the axial grooved heat pipes 12 to a flux that is manageable and on the order of 5 $W/cm^2$ or less. The heat can then be transferred along the length of the axial grooved heat pipes 12 to a heat sink (not shown) some distance away from the heat source where it can be rejected. The porous media heat pipes 14 can be used to spread the heat along the axial grooved heat pipes 12 and/or to transfer heat to/from a remote location, such as the heat spreader 18, as shown in FIG. 2.

Although the porous media heat pipes 14 are positioned in flanges 20 in the embodiment shown in FIGS. 1 through 3, the porous media heat pipes 14 may be placed anywhere along the length of the axial groove heat pipes 12. The porous media heat pipes 14 may be embedded into the flange(s) 20, wall(s), or within other bore(s) of the axial groove heat pipes 12. Alternatively, the porous media heat pipes 14 may be attached to the axial groove heat pipes 12 by solder, epoxy, mechanically and/or other known methods. The porous media heat pipes 14 may extend over one or more portions of the axial groove heat pipes 12 or may extend the entire length of the axial groove heat pipes 12.

Referring to FIG. 1, the porous media heat pipes 14 are embedded in the flange 20. In the embodiment shown, portions of the porous media heat pipes 14 extend in a direction which is parallel to the longitudinal axis of the axial groove heat pipe 12, while other portions of the porous media heat pipes 14 extend in a direction which is perpendicular to the longitudinal axis of the axial groove heat pipe 12. However, other configurations of the porous media heat pipes 14 may be used without departing from the scope of the invention.

Axial groove heat pipes 12 are often extruded with integral flanges 20 that can be used as the mounting surface for heat generating components. In other cases, one or more separate flanges are attached to the heat pipe evaporator of the axial groove heat pipes 12, typically by soldering or brazing.

The length and width of the flanges 20 may be varied depending upon the application and the amount of heat to be transferred. In addition, the number and positioning of the flanges can also be varied to better facilitate the transfer of heat.

In other embodiments, the porous wick heat pipe may be replaced by another high conductivity material that will act as a heat flux transformer. Such materials include, but are not limited to, copper, carbon composites, pyrolytic graphite and other metal matrix composites. The high conductivity material may be positioned to transfer heat between two or more axial grooved heat pipes.

In other embodiments, the porous wick heat pipe 14 is fabricated in the form of a vapor chamber.

Axial groove heat pipes 12 with capillary grooves have a very high permeability, allowing for operation in zero-g. The capillary grooves allow heat to be transported over long distances, typically several meters long or longer. The capillary grooves act as a wick having a large pore size. The large pore size is responsible for the high permeability of the axial groove heat pipe 12, but results in low pumping capability, thereby causing the axial groove heat pipe 12 to have a relatively low heat flux limitation. Consequently, heat assemblies 10 having axial groove heat pipe 12 are suitable for use in space, or for use in gravity aided sections of a heat pipe assembly 10. The axial groove heat pipe 12 allows the heat pipe assembly 10 to carrying power over long distances, such as to an ultimate heat sink. Working fluids which may be used for the axial groove heat pipes 12 include, but are not limited to, anhydrous ammonia, water, methanol, propylene, ethane and toluene.

While the axial groove heat pipes 12 are described as having capillary grooves provided along the entire length, other configurations may be used. Such other configurations, include, but not limited to, the axial groove heat pipes 12 having a combination capillary grooves and porous wicks. Such heat pipes are disclosed in co-pending U.S. patent application Ser. No. 13/506,623, which is incorporated by reference herein in its entirety.

Porous media heat pipes 14 are capable of accepting high heat fluxes, typically 50 $W/cm^2$ or higher. The porous media heat pipes 14 include porous wicks 34 provided about the periphery thereof. Examples of the wick materials include, but are not limited to, screen mesh, sintered powder, felts and foams. Examples of working fluids which may be used for the porous media heat pipes 14 include, but are not limited to, anhydrous ammonia, water, methanol, propylene, ethane and toluene.

Porous media heat pipes 14 may be designed to work in adverse elevation (for example, the evaporator elevated up to 12 inches above the condenser). In many cases, the heat pipe assembly 10 can be designed such that orientation with respect to gravity does not hinder thermal performance.

While the porous media heat pipes 14 are described as having a porous wick 34 provided along the entire length, other configurations may be used. Such other configurations include, but not limited to, the porous media heat pipes 14 having a combination of porous wicks in areas of high heat flux and grooved wicks 34 in areas of heat delivery.

In operation, high heat fluxes can be applied in one or more discrete locations or flanges 20 where the porous media heat pipes 14 are located. The working fluid in the porous media heat pipes 14 evaporates where the heat is supplied. The vapor travels to locations near the axial groove heat pipes 12 and condenses. By this action, the axial groove heat pipes 12 are subjected to a lower, more uniform heat flux.

Alternate embodiments of the heat pipe assembly are shown in FIGS. 2 and 3. As shown in FIG. 2, the heat pipe assembly 10 may include a flange or wall or condenser flange or heat spreader 18 which is removed from or remote from the axial grooved heat pipes 12. Porous media heat pipes 14 can also be embedded in the flange or wall or condenser flange or heat spreader 18, to improve the effective thermal conductivity. Porous media heat pipes 14 run or extend between the axial groove heat pipes to allow and facilitate heat to be transferred from the axial groove heat pipe 12 to the heat spreader 18. In the embodiment shown, multiple porous wick heat pipes 14 connect the flanges 20 with the heat spreader 18. In addition, multiple porous wick heat pipes 14 are embedded in the remote heat spreader 18.

In the embodiment shown, portions of the porous media heat pipes 14 of the heat spreader 18 extend in a direction which is parallel to the longitudinal axis of the axial groove heat pipe 12, while other portions of the porous media heat pipes 14 extend in a direction which is perpendicular to the longitudinal axis of the axial groove heat pipe 12. However, other configurations of the porous media heat pipes 14 may be used without departing from the scope of the invention.

Referring to FIG. 3, two axial groove heat pipes 12 with integral flanges 20 with multiple porous wick heat pipes 14 are shown. Porous media heat pipes 14 run or extend between the axial groove heat pipes 12 and the flanges 20 to allow heat to be shared or transferred between the two heat pipes 12. This is beneficial in applications in which high heat flux electronics provided proximate the heat pipe assemblies 10 are not expected to last the entire duration of the mission. In such applications, spare or redundant electronics must be provided. For example, three laser diodes might be mounted on the satellite in parallel. When one laser diode fails, the next laser diode is turned on. Using the type of configuration illustrated in FIG. 3, heat supplied by the active diode can be spread over multiple axial groove heat pipes 12. This allows survival heat to be supplied to the inactive diodes. In addition, more of the radiator panel is used, allowing the panel size to be reduced. A smaller panel size reduces mass, which is always vitally important on a satellite.

In the embodiment shown, portions of the porous media heat pipes 14 of the heat spreader 18 extend in a direction which is parallel to the longitudinal axis of the axial groove heat pipe 12, while other portions of the porous media heat pipes 14 extend in a direction which is perpendicular to the longitudinal axis of the axial groove heat pipe 12. However, other configurations of the porous media heat pipes 14 may be used without departing from the scope of the invention.

Figure 4:
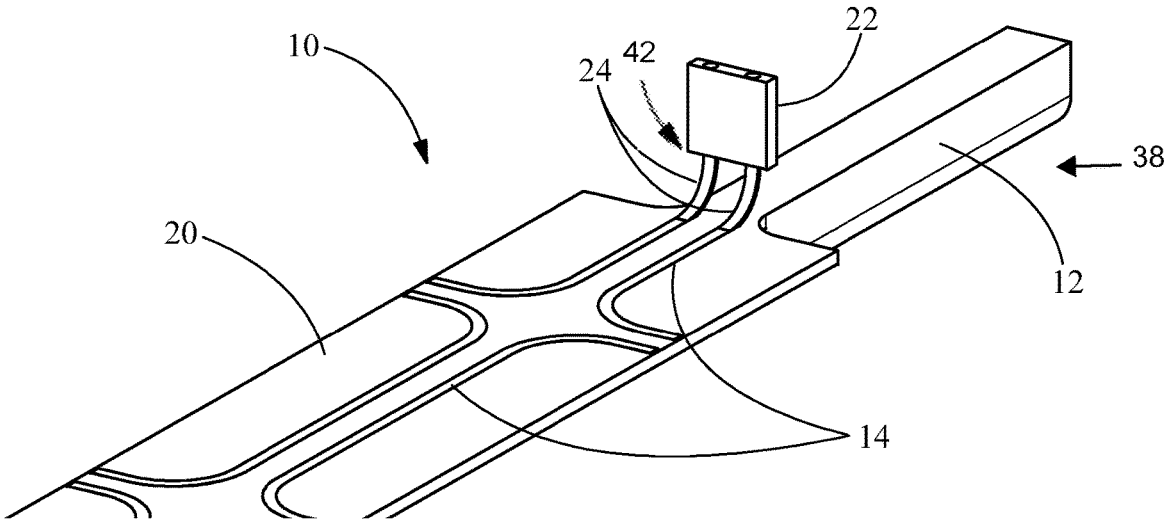
FIG. 4 is a partial enlarged perspective view of an illustrative embodiment of an axial groove heat pipe with a supplemental copper-water heat pipe used to contact heat generating components that are a higher elevation with respect to gravity.

Referring to FIG. 4, in various embodiments, the high heat flux electronics 22 may be located remotely from the evaporator 38 of the axial groove heat pipe 12. For example, the electronics 22 may be located at an elevation higher than the axial groove heat pipe 12 during ground testing. In such applications, a heat pipe 24 from the electronics 22 to the groove heat pipe 12 must have a porous wick 34 in the evaporator 42 of heat pipe 24. This allows the heat pipe 24 to handle the high heat fluxes without drying out. The adiabatic and condenser sections can also have a porous wick 34, or a hybrid wick heat pipe can be used. A hybrid wick has a porous evaporator, with the adiabatic and/or the condenser sections being grooved, which allows the heat pipe to carry more power than an all-porous wick heat pipe of the same dimensions. The heat pipe condenser may be embedded in the flange or inserted in a second bore of the grooved heat pipe.

A heat pipe 24 with an all porous wick 34 can allow for operation under much larger adverse elevations. For example, water heat pipes can operate against roughly up to 12 inches adverse elevation. In this embodiment, the porous media heat pipe 24 extends from the axial groove heat pipe 12 to bridge the gap between the heat pipe assembly 10 and heat source 22.

Figure 5:
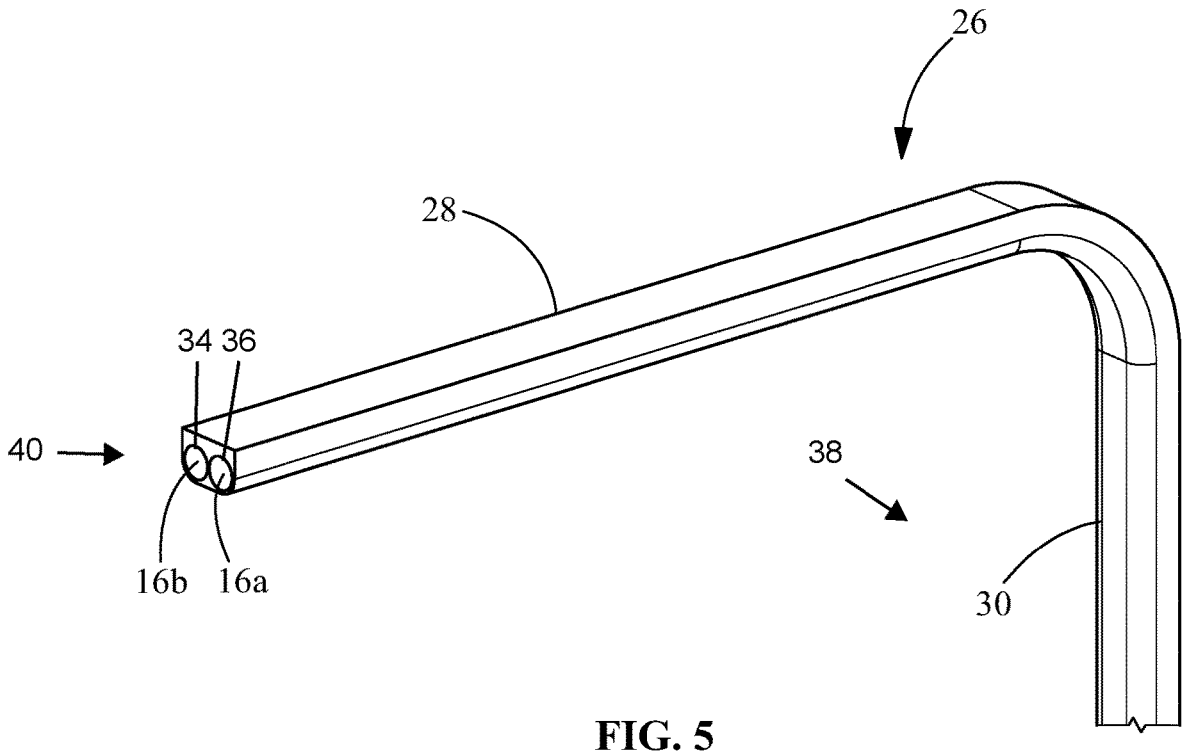
FIG. 5 is a partial perspective view of an illustrative embodiment of a heat pipe with a porous wick and axial groove wick.

As shown in FIG. 5, ground testing with an elevated heat source can also be conducted with a heat pipe 26 with at least two bores 16. One of the bores 16*a* has a grooved wick 36. The other bore 16*b* has a porous wick 34 in the elevated portion 28 of the bore 16*b* and grooves or a porous wick in the remainder 30 of the bore 16*b*. The porous wick 34 will operate against both gravity and high heat fluxes. During ground testing, the evaporator 38 is elevated above the condenser 40, and the bore 16*b* with the porous wick 34 carries power. In space, both the porous wick bore 16*b* and the axial groove bore 16*a* carry power.

As previously described, the porous wick heat pipes 14 are capable of operating at higher heat fluxes (up to 50 Watts/cm$^2$ or more) as compared to axial groove heat pipes 12. Heat from the porous wick heat pipes 14 is transmitted to the axial groove heat pipes 12. The benefit is that the porous heat pipes 14 act as a flux transformer, accepting a high heat flux over one or more small areas, and supplying the heat to the axial groove heat pipes 12. The porous wick pipes 14 can also operate against large elevational differences (including higher adverse elevations than the axial groove heat pipes 12) or with high heat fluxed from the electronics. The axial groove heat pipes 12 allow the heat pipe assembly 10 to operate in space, carrying power over long distances to the ultimate heat sink. In many applications, the combination of these heat pipes 12, 14 eliminates the need for conventional heat spreaders between the heat source and the heat pipe.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A heat pipe assembly comprising at least one axial groove heat pipe, and at least one additional heat pipe with a porous wick in an evaporator, the evaporator being located remotely from the axial groove heat pipe and can accept a heat flux of at least 50 W/cm$^2$, a condenser of the at least one additional heat pipe being attached to the axial groove heat pipe.

2. The heat pipe assembly as recited in claim 1, wherein the porous wick of the at least one additional heat pipe extends along the entire length of the heat pipe assembly.

3. The heat pipe assembly as recited in claim 1, wherein the porous wick of the at least one additional heat pipe is provided in the evaporator and the at least one additional heat pipe has a different wick in an adiabatic and/or the condenser sections.

4. The heat pipe assembly as recited in claim 1, where the at least one additional heat pipe is embedded into a flange of the axial groove heat pipe.

5. The heat pipe assembly as recited in claim 1, where the at least one additional heat pipe is embedded into a wall of the axial groove heat pipe.

* * * * *